US006877529B2

(12) United States Patent
Bernini

(10) Patent No.: US 6,877,529 B2
(45) Date of Patent: Apr. 12, 2005

(54) SEALING CAP IN PARTICULAR FOR A COLLECTOR TUBE IN AN AIR-CONDITIONING UNIT FOR VEHICLES

(75) Inventor: Michele Bernini, Parma (IT)

(73) Assignee: SKG Italia S.p.A., Scarzara - Parma (IT)

( * ) Notice: Subject to any disclaimer, the term of this patent is extended or adjusted under 35 U.S.C. 154(b) by 0 days.

(21) Appl. No.: 10/691,089

(22) Filed: Oct. 22, 2003

(65) Prior Publication Data

US 2004/0079427 A1 Apr. 29, 2004

(30) Foreign Application Priority Data

Oct. 29, 2002 (IT) ..... MI2002A2302

(51) Int. Cl.[7] ..... F16L 55/10
(52) U.S. Cl. ..... 138/89; 138/90; 220/237
(58) Field of Search ..... 138/89, 90, 96 R, 138/91; 220/237, 235

(56) References Cited

U.S. PATENT DOCUMENTS 3,326,404 A * 6/1967 Gardner ..... 220/235
3,494,504 A * 2/1970 Jackson ..... 220/237
3,613,936 A * 10/1971 Kaiser et al. ..... 220/237
3,917,292 A * 11/1975 Martin ..... 277/328
3,998,245 A * 12/1976 Martin ..... 138/89
4,531,550 A * 7/1985 Gartner ..... 138/89
5,228,476 A * 7/1993 Ashcroft ..... 138/89
6,513,549 B2 * 2/2003 Chen ..... 138/89

FOREIGN PATENT DOCUMENTS

DE 100 39 260 3/2001
GB 2117863 A * 10/1983 ..... F16L/55/10
NL 1 001 608 9/1996

OTHER PUBLICATIONS

International Search Report.

* cited by examiner

*Primary Examiner*—Patrick Brinson
(74) *Attorney, Agent, or Firm*—Hedman & Costigan, P.C.

(57) ABSTRACT

An improved sealing cap in particular for a collector tube in an air-conditioning unit for vehicles suitable for being axially inserted in a cylindrical portion (11) at an end of said collector tube comprises at least two moulded elements able to be coupled (12, 13, 22), a first (12) element being equipped with a portion (16) with the same diameter as the collector and at least one portion with a smaller diameter (17, 21) suitable for stably receiving a second element (13, 22) to define at least one seat (15, 150) for a sealing ring (14), which is realised with the coupling of the at least two elements. The portion with a smaller diameter (17, 21) defines a base of the seat (15, 150), a side surface (19, 28) of the second element (13, 22) and a side surface (20, 29) of the portion with the same diameter as the collector (16) respectively defining sides of said seat (15, 150).

9 Claims, 3 Drawing Sheets

Fig. 2
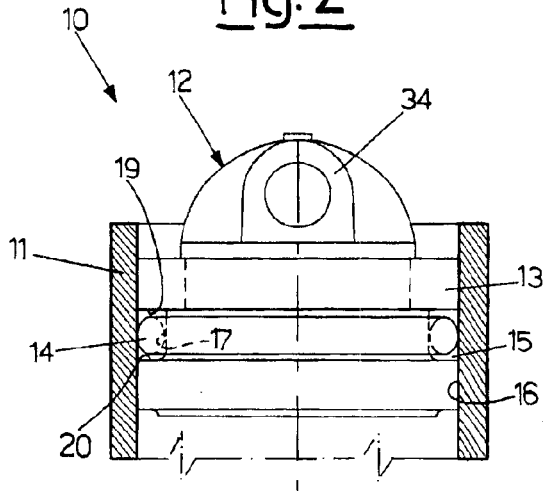
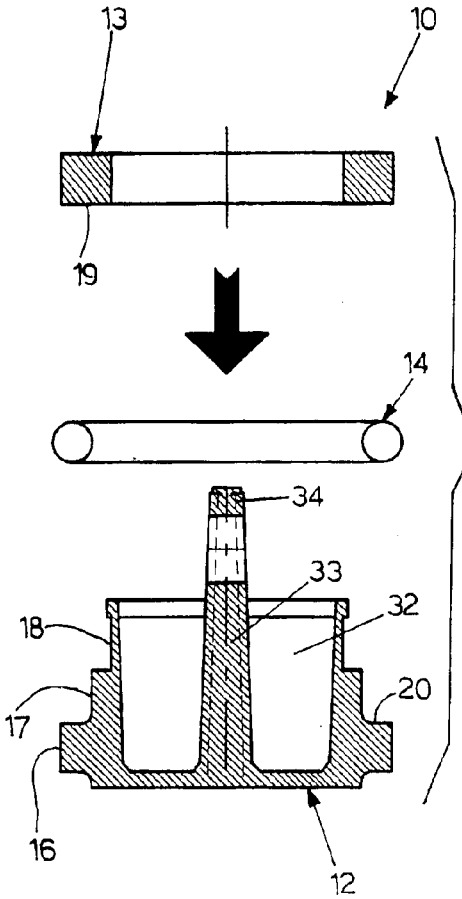
Fig. 1

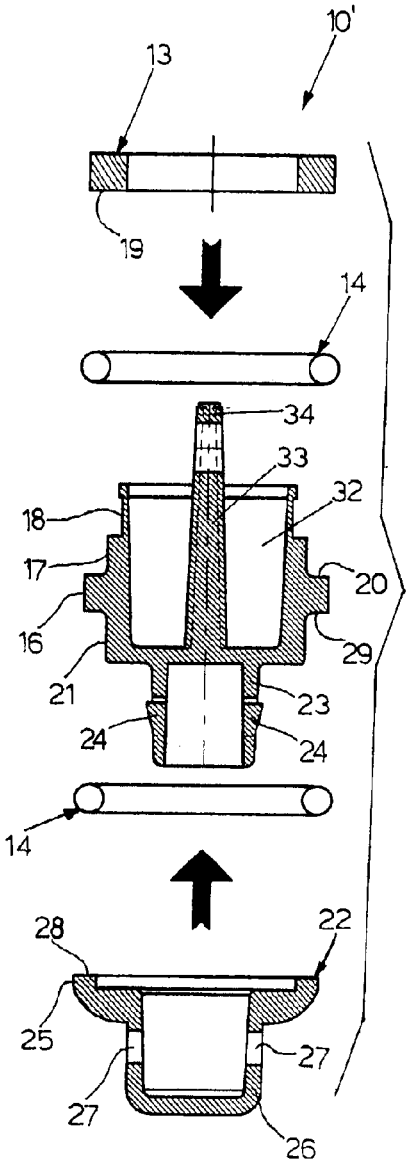
Fig.3
Fig.4
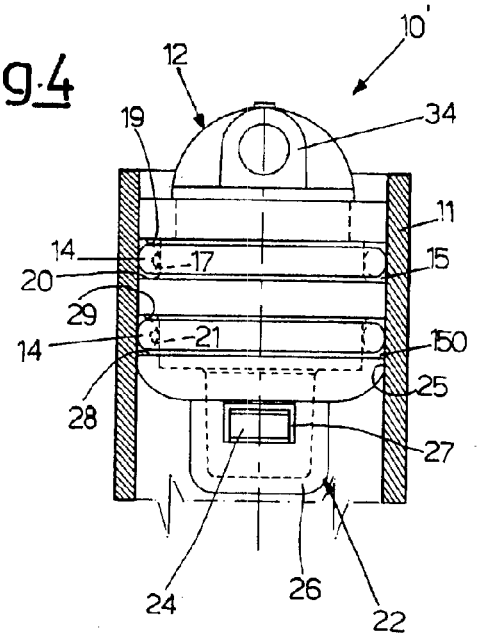

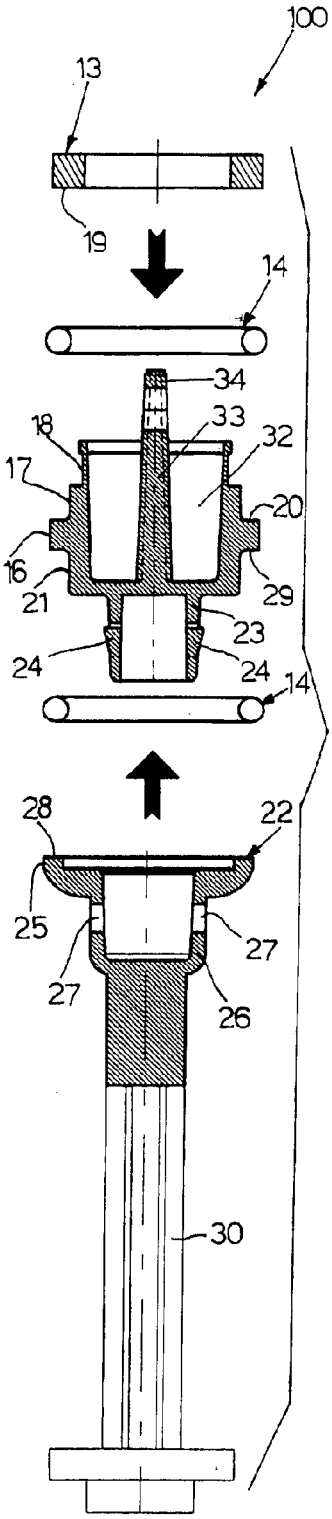
Fig.5
Fig.6
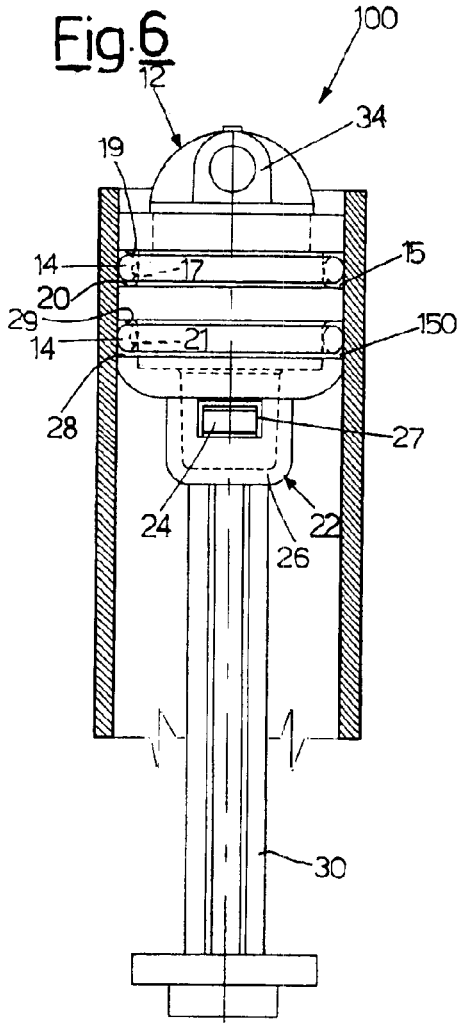
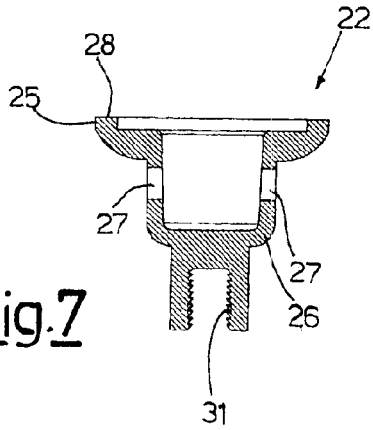
Fig.7

SEALING CAP IN PARTICULAR FOR A COLLECTOR TUBE IN AN AIR-CONDITIONING UNIT FOR VEHICLES

The present invention refers to an improved sealing cap in particular for a collector tube in an air-conditioning unit for vehicles.

An air-conditioning unit for vehicles comprises, amongst other things, a condenser, a drying means for removing water particles from the cooling liquid and a filtering element to hold impurities which may be present in the cooling liquid.

As an alternative to the arrangement of a separate dehydrating filter, arranged in the air-conditioning unit between the condenser and the expansion valve, it has become widespread to integrate a drying means and a filtering element directly in a collector tube of the condenser.

The condenser equipped with an integrated dehydrating filter therefore has the task of removing water particles from the cooling liquid, filtering impurities which may be present in the cooling liquid and acting as an accumulator for a determined amount of liquid. The drying means and the filtering element, for example contained in a rigid or semi-rigid casing of various materials and of various types, must generally be replaced after a certain operating time of the air-conditioning unit. Alternatively, the drying means could be contained in permeable bags structurally separate from the filtering element. Also in this case it is suitable for the single components to be replaceable by accessing the inside of the collector.

The collector tube is therefore equipped at one cylindrical end thereof with a removable cap to allow access to the inner components.

It is common to use threaded caps made from aluminium or light alloy, as well as cylindrical caps equipped with at least one seat for the insertion of an O-ring which seals against the wall of the collector tube. This second type of cap is made either from alloy or from moulded plastic material.

The grooved cylindrical cap is moulded in a single piece through two symmetrical half-moulds. On the moulded cap, in the jointing zone between the two half-moulds, there are imperfections or moulding burrs, which also cover the work throats of the sealing rings. In operating conditions, the cooling liquid inside the collector tube reaches very high pressure values. The cap is therefore heavily stressed and the imperfections present on the base of the seats of the sealing rings can cause harmful leaking of the cooling liquid out from the collector tube.

Purpose of the present invention is that of realising an improved sealing cap in particular for a collector tube in an air-conditioning unit for vehicles which avoids leaking of liquid even at high pressure.

Another purpose of the present invention is that of realising an improved sealing cap in which the moulding imperfections in the jointing zone between the two half-moulds are not present at the work seats of the sealing rings.

Another purpose of the present invention is that of realising an improved sealing cap in particular for a collector tube in an air-conditioning unit for vehicles that is particularly simple and functional, with low costs.

These purposes according to the present invention are accomplished by realising an improved sealing cap as outlined in claim 1.

Further characteristics are foreseen in the dependent claims.

The characteristics and advantages of an improved sealing cap in particular for a collector tube in an air-conditioning unit for vehicles according to the present invention shall become clearer from the following description, given as an example and not for limiting purposes, referring to the attached schematic drawings, in which:

FIG. 1 is an exploded section view according to a diametric plane of a first embodiment of an improved sealing cap in particular for a collector tube in an air-conditioning unit for vehicles, object of the present invention;

FIG. 2 is a top side view of the cap of FIG. 1 mounted and inserted in a cylindrical end of a collector tube shown only partially in section;

FIG. 3 is an exploded section view according to a diametric plane of a second embodiment of an improved sealing cap according to the present invention;

FIG. 4 is a top side view of the cap of FIG. 3 mounted and inserted in a cylindrical end of a collector tube shown only partially in section;

FIG. 5 is an exploded section view according to a diametric plane of a third embodiment of an improved sealing cap, object of the present invention;

FIG. 6 is a top side view of the cap of FIG. 5 mounted and inserted in a cylindrical end of a collector tube shown only partially in section;

FIG. 7 shows a further embodiment of an element that can be coupled with an improved sealing cap shown in the previous figures.

With reference to FIGS. 1 and 2, a first embodiment of an improved sealing cap in particular for a collector tube in an air-conditioning unit for vehicles is shown, wholly indicated with 10.

The cap 10, as shown in the exploded view, comprises two elements 12 and 13 moulded in plastic material able to be stably coupled together with interposition of an elastic sealing ring, an O-ring 14 housed in a seat 15. A first element 12 is equipped with a portion 16 with the same diameter as a cylindrical end 11 of a collector tube, in which the cap 10 is inserted (FIG. 2), as well as an adjacent portion with a smaller diameter 17, suitable for receiving the second element 13 in a stable manner to define the seat 15 for the sealing ring 14.

In the first cap 10, shown as a non-limiting example, the second element 13 consists of a ring with the same diameter as the collector 11, snap-slotted onto a recessed throat 18, which extends from the portion with a smaller diameter 17 to realise attachment means.

The seat 15 for the O-ring, realised by stably coupling together the two moulded elements 12 and 13, has a base with high surface finish defined by the portion with a smaller diameter 17 of the first element 12, as well as sides respectively defined by a side surface 19 of the second element 13 and a side surface 20 of the portion 16 with the same diameter as the collector of the first element 12.

A second embodiment of an improved sealing cap 10' in particular for insertion in the cylindrical portion 11 of a collector tube of an air-conditioning unit for vehicles foresees the arrangement of two seats 15 and 150 to receive two elastic sealing rings 14, as shown in FIGS. 3 and 4.

The constructive elements, substantially unvaried also in their operation with respect to that which has previously been outlined regarding the first embodiment, are identified by the same reference numerals and are not once again described here in detail.

In the cap 10', the first moulded element 12 comprises a further portion with a smaller diameter 21 suitable for receiving a third moulded element 22 which can be stably coupled to define the seat 150 for the second sealing ring 14.

Attachment means for the third element 22 extend from the further portion 21 with a smaller diameter which is arranged, with respect to the first portion with a smaller diameter 17, on the opposite side to the portion 16 with the same diameter as the collector.

In the example shown, a tubular body 23, for example cylindrical, carrying two attachment teeth 24 on the outside for the engagement of complementary elements of the third moulded element 22 extends from the portion with a smaller diameter 21 of the first element 12.

The third element 22 comprises an annular portion 25 with the same diameter as the collector and a hollow tubular portion 26, suitable for receiving the tubular part 23 of the first element 12.

The hollow tubular portion 26 is equipped with two openings 27 in a position to match the attachment teeth 24, which constitute the matching elements for the snap engagement between the two pieces which can be stably coupled.

The second seat 150 for the sealing ring 14, realised by stably coupling together the moulded elements 12 and 22, therefore has a base with high surface finish defined by the second portion with a smaller diameter 21 of the first element 12, as well as sides respectively defined by a side surface 28 of the third element 22 and a side surface 29 of the portion 16 with the same diameter as the collector of the first element 12.

The moulded elements 12, 13 and 22 which can be coupled, which in the examples shown are stably coupled through fixed attachment means, can also be electrowelded with ultrasound, since it is not necessary to foresee the possibility of disassembly of the assembled cap.

A third embodiment of an improved sealing cap 100, according to the invention is shown in FIGS. 5 and 6. The only difference with respect to that which has been described regarding the cap 10' shown in FIGS. 3 and 4 is represented by the third element 22, which is moulded integrally with a spacer shaft 30 that can be coupled with a filtering cartridge, not shown, suitable for containing a drying means and a filtering element for the cooling liquid circulating in the collector tube.

In FIG. 7 a further embodiment of the third moulded element 22 able to be coupled is represented equipped with an element 31 for the connection of accessories, for example consisting of a threaded hole. Accessories that can be connected to such a base can for example be a spacer shaft for a filtering and drying cartridge, a permeable bag suitable for containing a drying means, or else directly a filtering and drying cartridge, not shown.

Indeed, the improved sealing cap, object of the present invention, can both be of the type separably or permanently connected for example to the cartridge, in order to remove the cartridge, or other element to be replaced at the same time as the removal of the cap, and of the type singularly removable to access a drying means and to a filtering element contained in the collector tube.

As an example, in the figures caps 10, 10' and 100 are shown, in which the portions with a smaller diameter 17 and 21 which realise the base of the seats 15 and 150 for the O-rings are both realised on the first element 12, but at least one seat could also be realised on the second and/or third element, respectively.

In all of the embodiments described as an example the first element 12 is realised equipped with an inner recess 32 diametrically divided by a transversal wall 33, which protrudes at one end of the cap to form a gripper tab 34.

The moulded cap, object of the present invention, is therefore advantageously equipped with walls with a roughly constant thickness to avoid anomalous and uncontrolled shrinking phenomena of the material during cooling. Indeed, the increased dimensional precision has a positive influence on the seal of the cap.

The improved sealing cap in particular for a collector tube in an air-conditioning unit for vehicles object of the present invention has the advantage of having work seats for the sealing rings with a base with a high surface finish.

The base with a high surface finish is advantageously realised in the moulding step without the need to carry out subsequent finishing treatment.

Moreover, the elastic sealing rings are advantageously positioned in their seats at the moment of coupling of the single elements constituting the cap. The O-rings are not thus subjected to traction in the assembly step, an operation which could jeopardise the mechanical sealing characteristics thereof.

The improved sealing cap thus conceived is susceptible to numerous modifications and variants, all covered by the invention; moreover, all of the details can be replaced by technically equivalent elements. In practice, the materials used, as well as the sizes, can be whatever according to the technical requirements.

What is claimed is:

1. Improved sealing cap in particular for a collector tube in an air-conditioning unit for vehicles suitable for being axially inserted in a cylindrical portion (11) at an end of said collector tube, comprising at least two molded elements able to be coupled (12, 13, 22), a first molded element (12) of said at least two molded elements having an internal recess (32) with at least one transversal wall (33), protruding at one end suitable for receiving an element that can be coupled, and being equipped with a portion (16) with the same diameter as the collector tube and at least one portion with a smaller diameter (17, 21), said at least one portion with a smaller diameter (17, 21) extends in a further portion (18, 23) of smaller diameter suitable for stably receiving a second element (13, 22) to define at least one seat (15, 150) for a sealing ring (14) when said at least two elements are coupled, said portion with a smaller diameter (17, 21) than said portion (16) with the same diameter as the collector defining a base of said seat (15, 150), a side surface (19, 28) of said second element (13, 22) and a side surface (20, 29) of said portion with the same diameter as the collector (16) respectively defining sides of said seat (15, 150), said cap including a third element (22) adapted to be coupled to said first element (12), said first element (12) being equipped with a further portion (17, 21) with a smaller diameter suitable for defining a second further seat (15, 150) for a sealing ring (14) upon stable coupling of said first and third elements (12, 22), said further portion with a smaller diameter (17, 21) defining a base of said second seat (150), a side surface (19, 28) of said third element (13, 22) and a side surface (20, 29) of said portion with the same diameter as the collector (16) respectively defining sides of said further seat (15, 150).

2. Improved sealing cap in particular for a collector tube in an air-conditioning unit for vehicles suitable for being axially inserted in a cylindrical portion (11) at an end of said collector tube, comprising at least two molded elements able to be coupled (12, 13, 22), a first molded element (12) of said at least two molded elements having an internal recess (32) with at least one transversal wall (33), protruding at one end suitable for receiving an element that can be coupled, and being equipped with a portion (16) with the same diameter as the collector tube and at least one portion with a smaller diameter (17, 21), said at least one portion with a smaller diameter (17, 21) extends in a further portion (18, 23) of smaller diameter suitable for stably receiving a second element (13, 22) to define at least one seat (15, 150) for a sealing ring (14) when said at least two elements are coupled, said portion with a smaller diameter (17, 21) than said portion (16) with the same diameter as the collector defining a base of said seat (15, 150), a side surface (19, 28) of said second element (13, 22) and a side surface (20, 29) of said portion with the same diameter as the collector (16) respectively defining sides of said seat (15, 150), said cap including a third element (22) adapted to be coupled to said first element (12), said first element (12) being equipped with a further portion (17, 21) with a smaller diameter suitable for defining a second further seat (15, 150) for a sealing ring (14) upon stable coupling of said first and third elements (12, 22), said further portion with a smaller diameter (17, 21) defining a base of said second seat (150), a side surface (19, 28) of said third element (13, 22) and a side surface (20, 29) of said portion with the same diameter as the collector (16) respectively defining sides of said further seat (15, 150), wherein said at least one portion with a smaller diameter (17, 21) extends in a further portion (18, 23) having attachment means, and said attachment means comprise a recessed throat (18) suitable for receiving an element that can be coupled (13) with pressure.

3. Cap according to claim 2, wherein said attachment means comprises a tubular body (23) carrying at least one attachment tooth (24) on the outside for engagement with at least one matching element (27).

4. Cap according to claim 3, wherein said third molded element (22) which can be coupled with said first element (12) comprises an annular portion with the same diameter as the collector (25) and at least one hollow tubular portion (26), suitable for receiving said tubular body (23) of the first element (27) matching said at least one attachment tooth (24) suitable for snap engaging.

5. Cap according to claim 2, wherein said at least one transversal wall (33), protruding at one end to form a gripper tab (34).

6. Cap according to claim 2, wherein said second molded element which can be coupled with said first element (12) is a ring (13) with the same diameter as the collector.

7. Cap according to claim 2, wherein said third element (22) is molded integral with a spacer shaft (30) suitable for being connected to a filtering cartridge.

8. Cap according to claim 7, wherein said third element (22) is equipped with an element (31) for connection to accessories.

9. Cap according to claim 2, wherein said at least one portion with a smaller diameter (17, 21) than said portion (16) with the same diameter as the collector, forming said base of said at least one seat (15, 150) for a sealing ring (14) has a high surface finish.

* * * * *